US006758350B2

(12) United States Patent
Lin

(10) Patent No.: US 6,758,350 B2
(45) Date of Patent: Jul. 6, 2004

(54) WRENCH RACK

(76) Inventor: Clare Lin, No. 21, Kuan Chien Street, Lu Kang Town, Chang Hua Hsien (TW)

( * ) Notice: Subject to any disclaimer, the term of this patent is extended or adjusted under 35 U.S.C. 154(b) by 0 days.

(21) Appl. No.: 10/244,288

(22) Filed: Sep. 16, 2002

(65) Prior Publication Data

US 2003/0141266 A1 Jul. 31, 2003

(30) Foreign Application Priority Data

Jan. 25, 2002 (TW) ..... 91200874 U

(51) Int. Cl.[7] ..... A47F 7/00

(52) U.S. Cl. ..... 211/70.6; 206/376; 294/161; 294/169

(58) Field of Search ..... 211/70.6; 206/376; 294/146, 161, 167, 169

(56) References Cited

U.S. PATENT DOCUMENTS 3,370,696 A * 2/1968 Gvoe
4,310,094 A * 1/1982 Hotchkiss ..... 211/70.6
5,036,975 A * 8/1991 Chow ..... 206/376
5,346,063 A * 9/1994 Chow ..... 206/376
5,598,924 A * 2/1997 McCann ..... 206/372
5,659,440 A * 8/1997 Acosta et al. ..... 294/169 X
5,967,340 A * 10/1999 Kao ..... 211/70.6
D433,613 S * 11/2000 Jailin
6,360,892 B1 * 3/2002 Chen ..... 206/376
6,401,923 B1 * 6/2002 Huang ..... 206/376
6,536,611 B2 * 3/2003 Chen ..... 211/70.6

* cited by examiner

*Primary Examiner*—Robert W. Gibson, Jr.
(74) *Attorney, Agent, or Firm*—Alan D. Kamrath; Nikolai & Mersereau, P.A.

(57) ABSTRACT

A wrench rack includes a board and at least one clip formed on the board. The at least one clip includes a first jaw and two second jaws for retaining a wrench handle between the first jaw and the second jaws. The wrench rack may include a handle pivotally connected with the board. The wrench rack may include a cover pivotally connected with the board. The cover may include a hook formed thereon for hooking the board. The first jaw includes a hooking portion formed thereon. In a first aspect, each of the second jaws includes a ridge formed thereon. In a second aspect, each of the second jaws includes a hooking portion formed thereon.

14 Claims, 8 Drawing Sheets

WRENCH RACK

BACKGROUND OF INVENTION

1. Field of Invention

The present invention relates to a wrench rack for clipping wrenches.

2. Related Prior Art

Taiwan Patent Publication No. 369994 teaches a combinative wrench rack including a handle 20 and a plurality of clips 30. In the handle 20 is defined a recess 21 so that the wrench rack can be hung on a nail or hook secured to a wall or the like. On the lower edge of the handle 20 are formed a main hook 22 and two auxiliary hooks 23 so that the main hook 22 is located between the auxiliary hooks 23. On a lower edge of each of the clips 30 are formed a main hook 32 and two auxiliary hooks 33 so that the main hook 32 is located between the auxiliary hooks 33. The hook 32 is identical to the main hook 22. The auxiliary hooks 33 are identical to the auxiliary hooks 23. On an upper end of each of the clips 30 is formed an engagement plate 34 in which a main recess 35 and two auxiliary recesses 36 are defined. The main hook 22 and the auxiliary hooks 23 can be inserted in the main recess 35 and the auxiliary recesses 36, thus attaching one of the clips 30 to the handle 20. The main hook 32 and the auxiliary hooks 33 of the first clip 30 can be inserted in the main recess 35 and the auxiliary recesses 36 of a second clip 30, thus attaching the second clip 30 to the first clip 30. The handle 20 and the clips 30 can thus be combined. Each of the clips 30 includes a first jaw 37 and a second jaw 38. The first jaw 37 assumes the form of a bow. That is, the first jaw 37 includes two branches that firstly extend laterally from the first jaw 37 and later extend towards the second jaw 38 extending from a front face of each of the clips 30. A tooth 372 extends from an end 371 of each of the branches of the first jaw 37. A tooth 382 extends from the jaw 38. A wrench handle can be clipped by means of each of the clips 30 when it is bitten by means of the teeth 372 and 382. However, the teeth 372 may be broken easily. Moreover, the combinative wrench rack is complicated in structure.

Therefore, the present invention is intended to obviate or at least alleviate the problems encountered in the prior art.

SUMMARY OF INVENTION

It is an objective of the present invention to provide a robust wrench rack.

It is another objective of the present invention to provide a simple wrench rack.

According to the present invention, a wrench rack is provided including a board and at least one clip formed on the board. The at least one clip includes a first jaw and two second jaws for retaining a wrench handle between the first jaw and the second jaws.

The wrench rack may include a handle pivotally connected with the board.

The wrench rack may include a cover pivotally connected with the board. The cover may include a hook formed thereon for hooking the board.

The first jaw includes a stop formed thereon. The stop of the first jaw may include an inclined face for smooth movement of the wrench handle past it to the position between the first jaw and the second jaws.

In a first aspect, each of the second jaws includes a ridge formed thereon.

In a second aspect, each of the second jaws includes a stop formed thereon. The stop may include an arc-shaped face for smooth movement of the wrench handle past it to the position between the first jaw and second jaws.

Other objectives advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Figure 1:
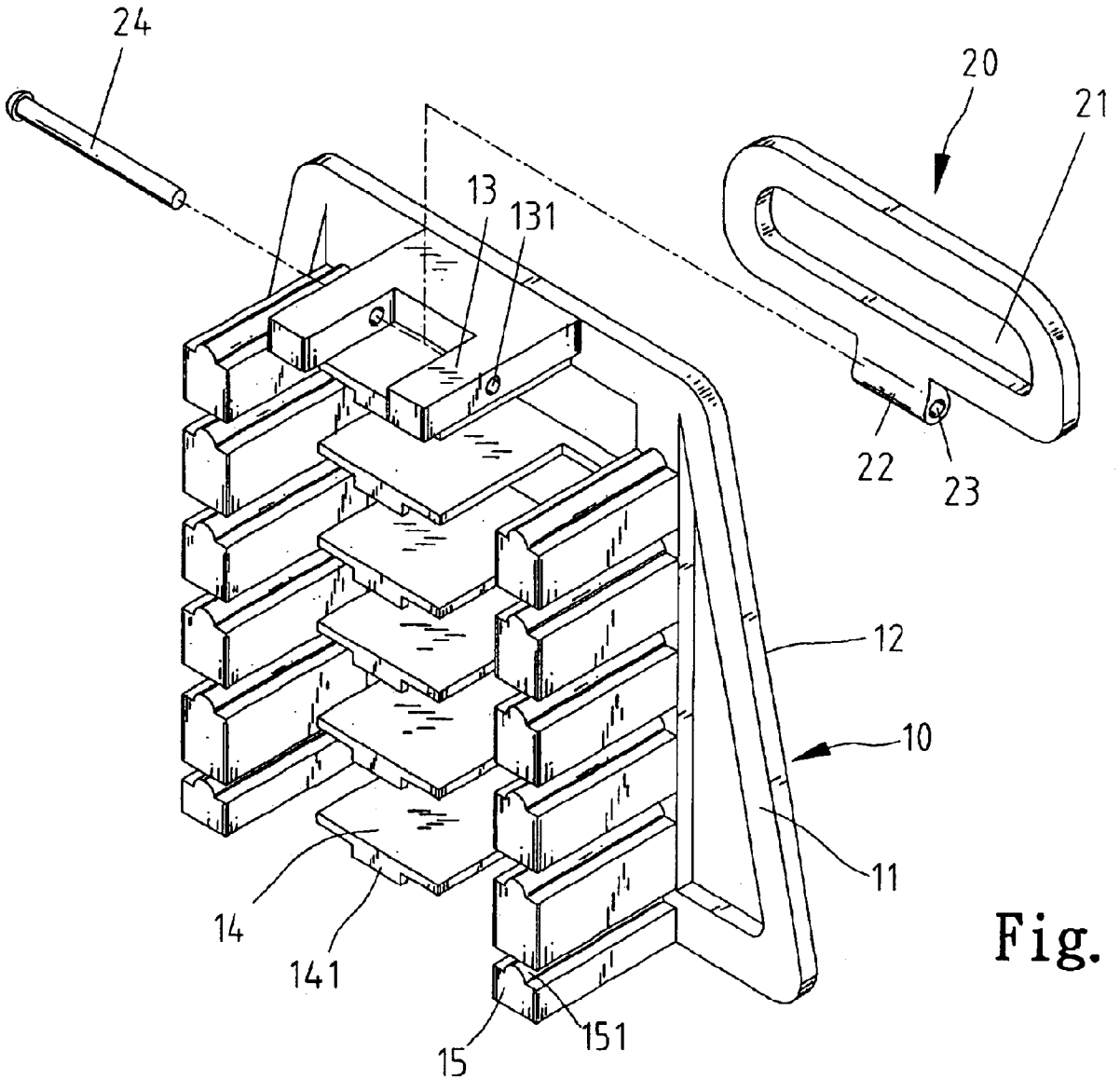
FIG. 1 is an exploded view of a wrench rack according to the preferred embodiment of the present invention.
Figure 2:
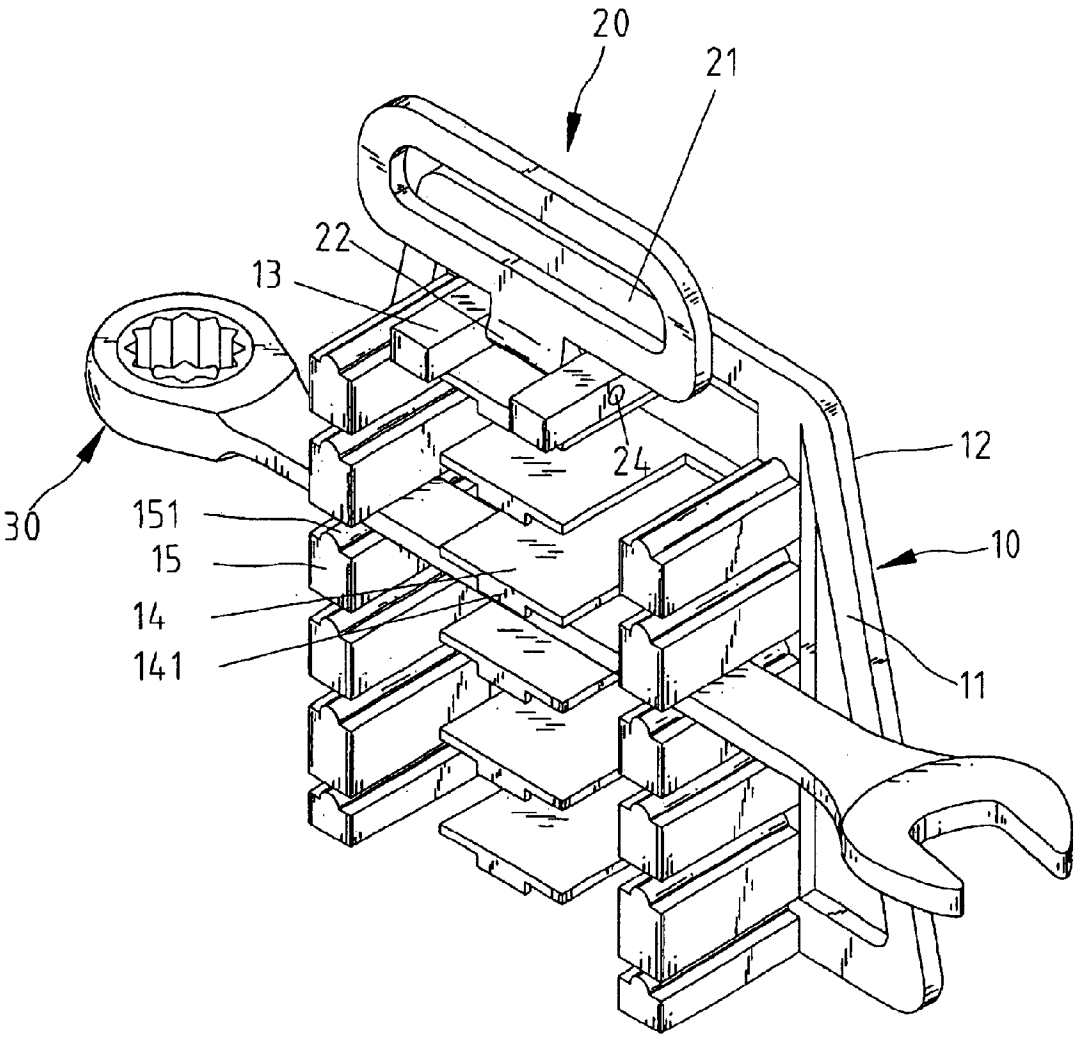
FIG. 2 is a perspective view of the wrench rack according to the preferred embodiment of the present invention.

Referring to FIGS. 1 and 2, according to the preferred embodiment of the present invention, a wrench rack includes a board 10 and a handle 20 pivotally connected with the board 10. The board 10 includes a front face 11 and a rear face 12. Two separate connection portions 13 are formed on the front face 11. Each of the connection portions 13 defines an aperture 131. On an edge of the handle 20 is formed a connection portion 22 defining an aperture 23. The connection portion 22 is located between the connection portions 13 and a pin 24 is inserted in the apertures 131 and 23, thus pivotally connecting the handle 20 with the board 10. A hole 21 is defined in the handle 20 so that the handle 20 can be hung on a nail or hook mounted on a wall or the like.

A number of clips are formed on the front face of the board 10. Each of the clips includes an upper jaw 14 and two lower jaws 15. A stop 141 is formed on a lower face of the upper jaw 14. A ridge 151 is formed on an upper face of each of the lower jaws 15.

Figure 3:
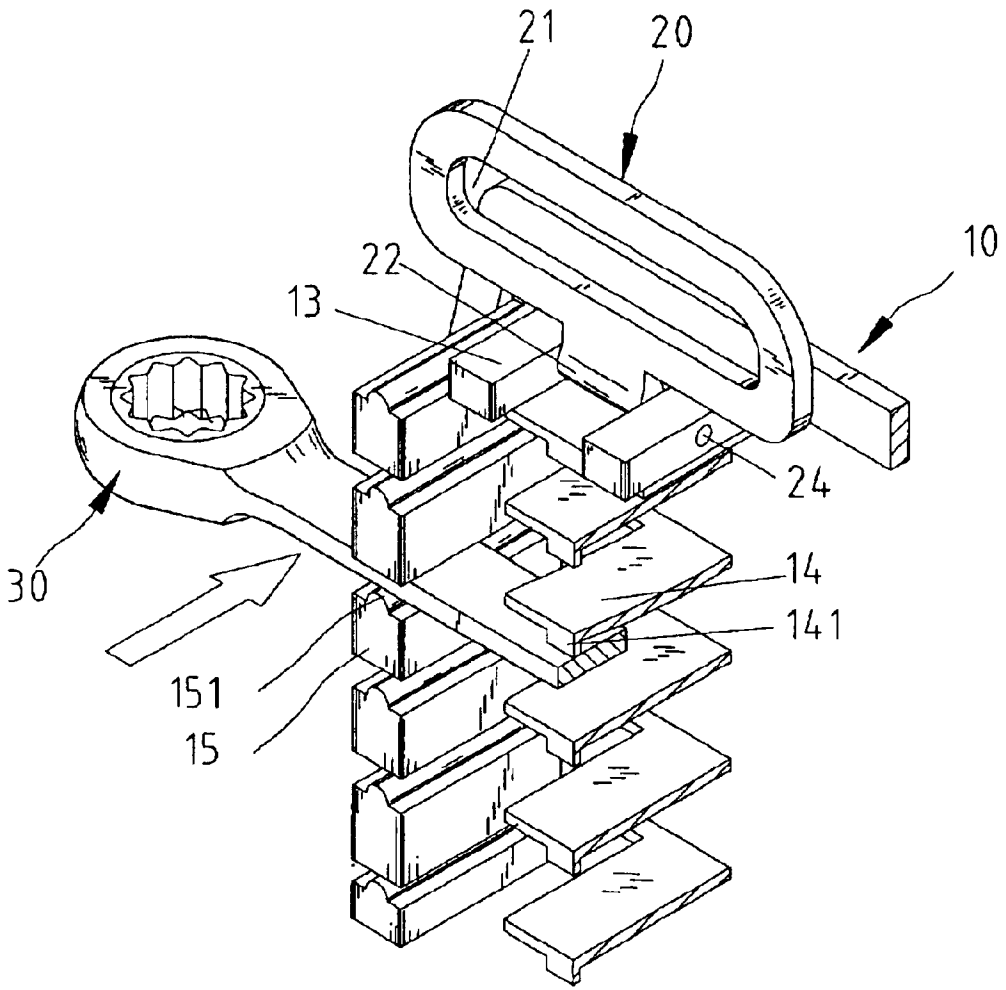
FIGS. 3 and 4 are fragmentary cross-sectional views of the wrench held by means of the wrench rack according to the present invention.

Referring to FIG. 3, during movement of a wrench handle 30 between the upper jaw 14 and the lower jaws 15, in a short period of time, the wrench handle 30 is in contact with the stop 141 of the upper jaw 14 so as to deform the upper jaw 14.

Figure 4:
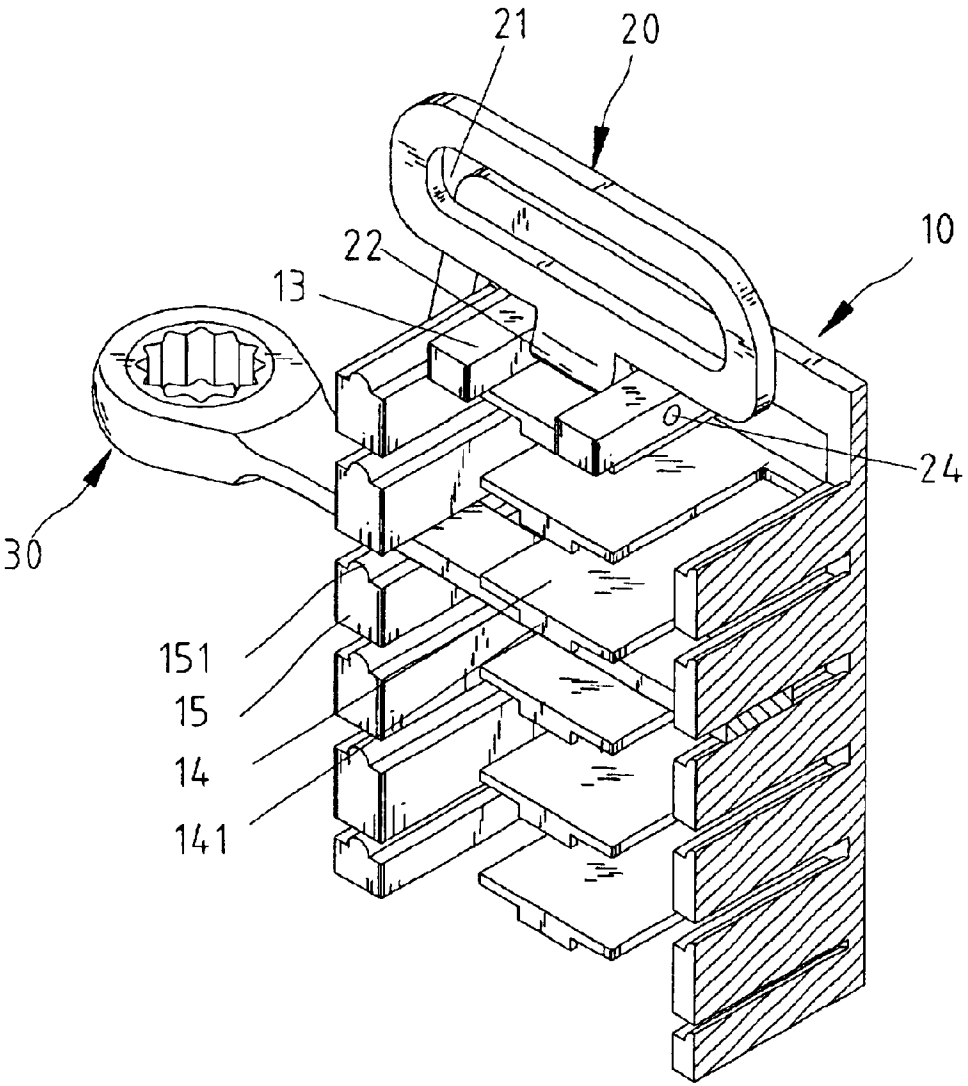

Referring to FIG. 4, the wrench handle 30 has been moved past the stop 141 of the upper jaw 14. Thus, the wrench handle 30 is retained between the upper jaw 14 and the lower jaws 15 by means of the stop 141 of the upper jaw 14.

Figure 5:
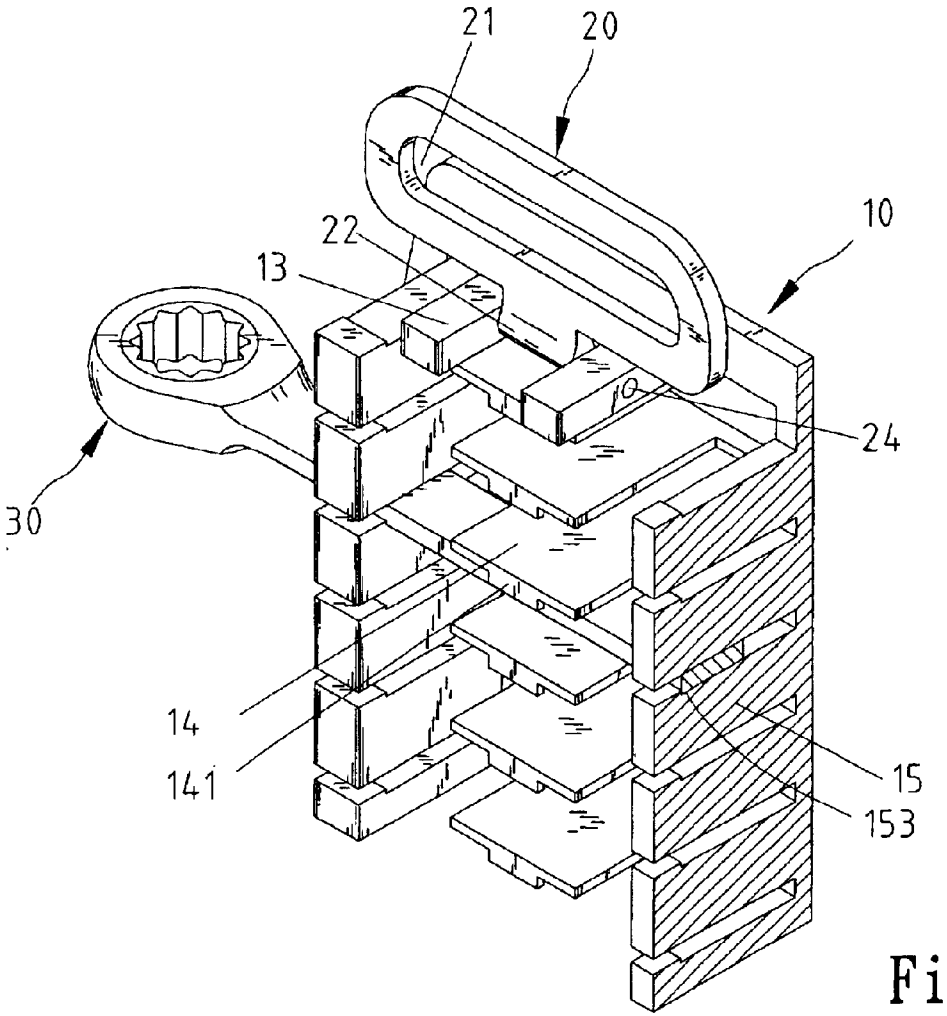
FIG. 5 is a fragmentary cross-sectional view of a wrench rack according to a second embodiment of the present invention.

FIG. 5 shows a wrench rack according to a second embodiment of the present invention. The second embodiment is identical to the first embodiment except for using a stop 153 instead of the ridge 151. The function of the stop 153 of each of the lower jaws 15 is similar to that of the upper jaw 14.

Figure 6:
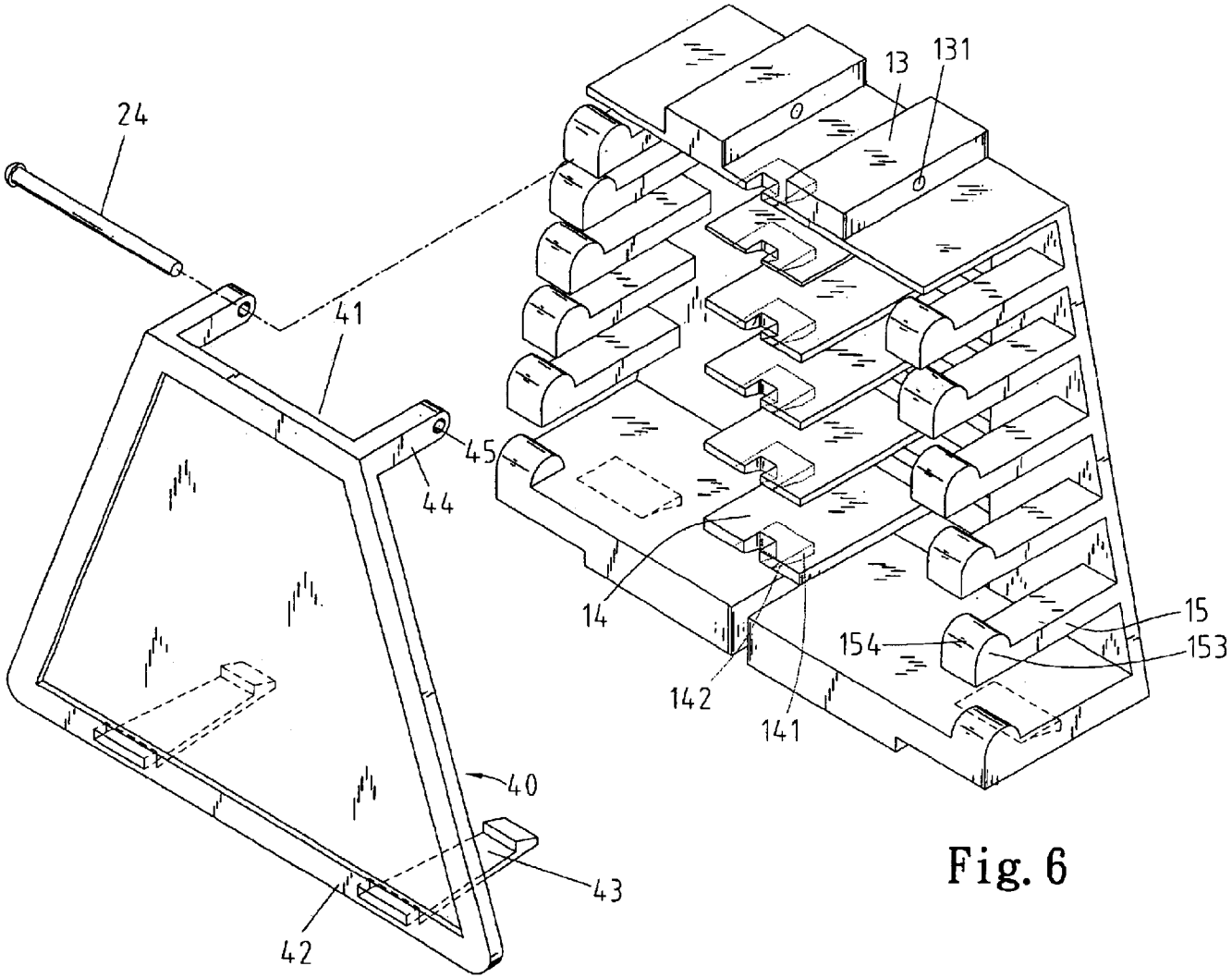
FIG. 6 is a perspective view of a wrench rack according to a third embodiment of the present invention.
Figure 7:
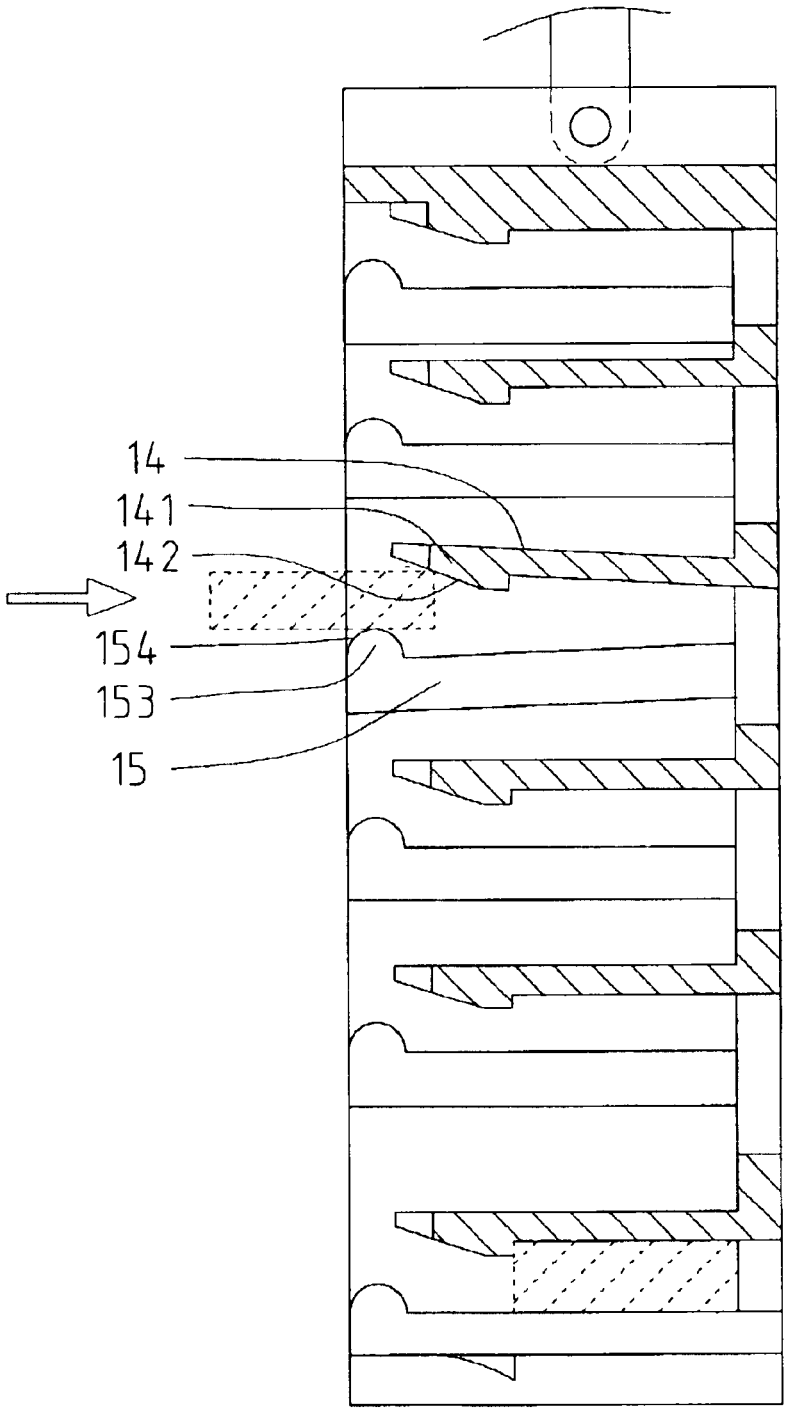
FIG. 7 is a cross-sectional view of the wrench rack according to the third embodiment of the present invention.

FIGS. 6 and 7 shows a wrench rack according to a third embodiment of the present invention. The third embodiment is identical to the second embodiment except for that the stop 141 includes an inclined face 142 and that the stop 153 includes an arc-shaped face 154. Thus, the wrench handle can be smoothly moved past the stops 141 and 153.

Figure 8:
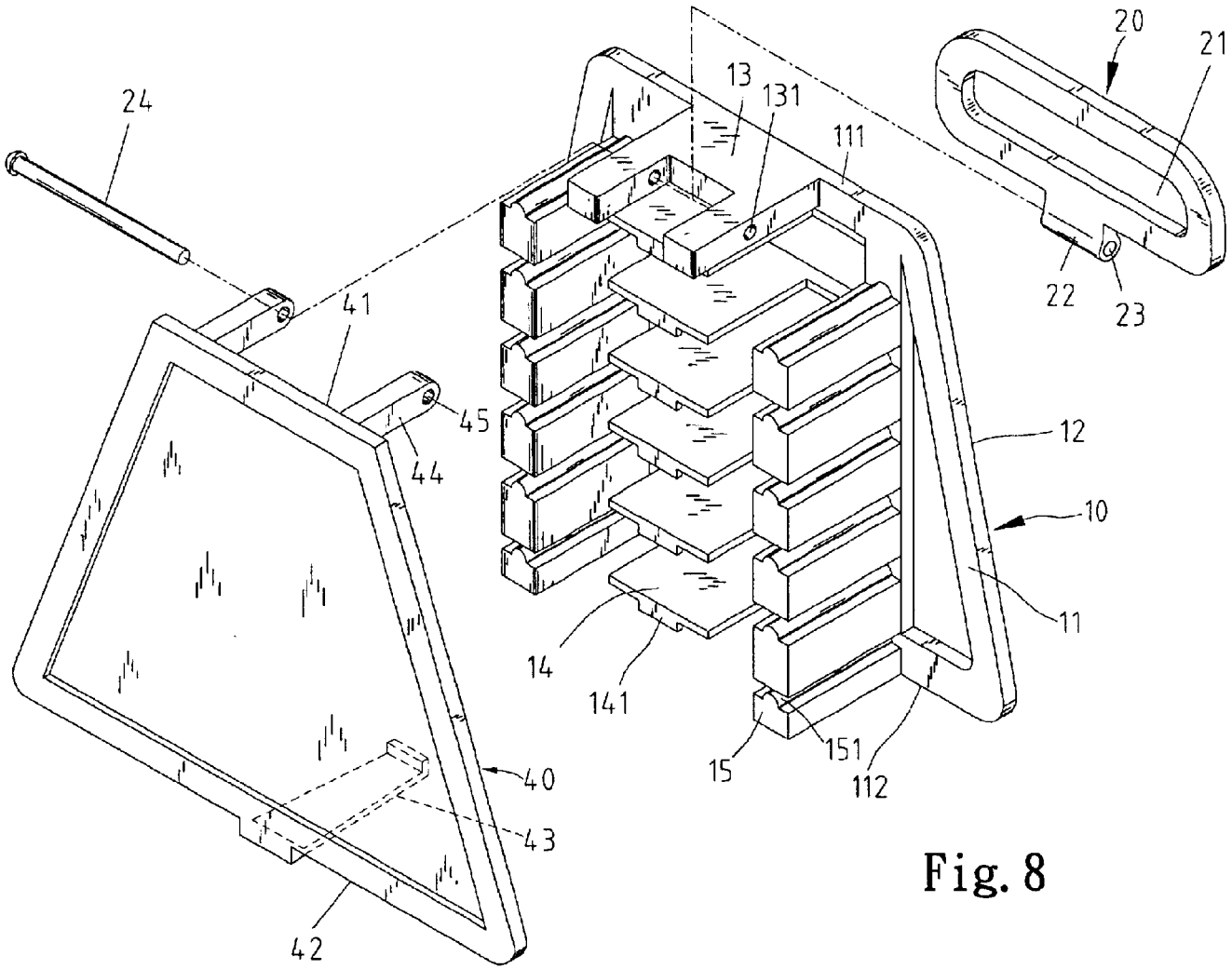
FIG. 8 is an exploded view of a wrench rack according to a fourth embodiment of the present invention.

FIG. 8 shows a wrench rack according to a fourth embodiment of the present invention. The fourth embodiment is identical to the first embodiment except for including a cover 40. The cover 40 is pivotally connected with the board 10. The cover 40 includes a frame and a transparent or translucent panel mounted on and within the frame. The cover 40 includes two separate connection portions 44 formed on a rear face of an upper portion 41 of the frame thereof. Each of the connection portions 44 defines an aperture 45. The connection portions 13 are located between the connection portions 44 and the pin 24 is inserted through the apertures 45, 131 and 23 so as to pivotally connect the cover 40 with the board 10. A hook 43 is formed on a rear face of a lower portion 42 of the frame of the cover 40. The hook 43 can be engaged with a lower edge of the board 10.

The present invention has been described through detailed illustration of the preferred embodiments. Those skilled in the art can derive many variations from the preferred embodiments without departing from the scope of the present invention. Therefore, the preferred embodiments shall not limit the scope of the present invention. The scope of the present invention is defined in the attached claims.

What is claimed is:

1. A wrench rack including:

a board; and at least one clip formed on the board, the at least one clip including a first jaw and two second jaws, with the first and second jaws each including a face, with the faces of the two second jaws defining a plane, with the face of the first jaw being parallel to and spaced from and intermediate the faces of the two second jaws, with the face of the first jaw including a stop spaced from the board, with the stop extending towards but spaced intermediate the plane defined by the faces of the two second jaws and the face of the first jaw, with the first jaw and the two second jaws retaining a wrench handle between the face of the first jaw and the faces of the two second jaws and between the stop and the board.

2. The wrench rack according to claim 1 including a handle connected with the board.

3. The wrench rack according to claim 2 wherein the handle is pivotally connected with the board.

4. The wrench rack according to claim 3 wherein the board includes two connection portions formed thereon and the handle includes a connection portion formed thereon for pivotal connection with the connection portions of the board.

5. A wrench rack including:

a board;

at least one clip formed on the board, the at least one clip including a first jaw and two second jaws for retaining a wrench handle between the first jaw and the second jaws;

a handle connected with the board, wherein the handle is pivotally connected with the board, wherein the board includes two connection portions formed thereon and the handle includes a connection portion formed thereon for pivotal connection with the connection portions of the board, wherein each of the connection portions defines an aperture; and a pin inserted in the apertures defined in the connection portions.

6. The wrench rack according to claim 1 including a cover connected with the board.

7. The wrench rack according to claim 6 wherein the cover is pivotally connected with the board.

8. The wrench rack according to claim 7 wherein the board includes two connection portions formed thereon and the cover includes two connection portions formed thereon for pivotal connection with the connection portions of the board.

9. A wrench rack including:

a board;

at least one clip formed on the board, the at least one clip including a first jaw and two second jaws for retaining a wrench handle between the first jaw and the second jaws;

a cover pivotally connected with the board, wherein the board includes two connection portions formed thereon and the cover includes two connection portions formed thereon for pivotal connection with the connection portions of the board, wherein each of the connection portions defines an aperture; and a pin inserted in the apertures defined in the connection portions.

10. The wrench rack according to claim 6 wherein the cover includes a hook formed thereon for hooking the board.

11. A wrench rack including:

at least one clip formed on the board, the at least one clip including a first jaw and two second jaws for retaining a wrench handle between the first jaw and the second jaws, wherein the first jaw includes a stop formed thereon, and wherein the stop includes an inclined face for smooth movement of the wrench handle past the stop to the position between the first jaw and the second jaws.

12. The wrench rack according to claim 1 wherein the faces of each of the two second jaws includes a ridge formed thereon parallel to the face and having an engaging area less than the face.

13. The wrench rack according to claim 1 wherein the faces of each of the two second jaws includes a stop formed thereon.

14. A wrench rack including:

a board; and at least one clip formed on the board, the at least one clip including a first jaw and two second jaws for retaining a wrench handle between the first jaw and the second jaws, wherein the first jaw includes a stop formed thereon, and wherein the stop includes an arc-shaped face for smooth movement of the wrench handle past the stop to the position between the first jaw and the two second jaws.

* * * * *